US006959580B2

(12) United States Patent
Break

(10) Patent No.: US 6,959,580 B2
(45) Date of Patent: Nov. 1, 2005

(54) SHEET METAL BENDING BRAKE

(76) Inventor: Douglas G. Break, 9925 Roseland, Livonia, MI (US) 48150

( * ) Notice: Subject to any disclaimer, the term of this patent is extended or adjusted under 35 U.S.C. 154(b) by 115 days.

(21) Appl. No.: 10/675,522

(22) Filed: Sep. 30, 2003

(65) Prior Publication Data

US 2004/0060337 A1 Apr. 1, 2004

Related U.S. Application Data

(60) Provisional application No. 60/414,907, filed on Sep. 30, 2002.

(51) Int. Cl.[7] ..... B21D 5/04; B25B 5/08

(52) U.S. Cl. ..... 72/319; 269/233; 269/236

(58) Field of Search ..... 72/319–321; 269/229, 269/233, 236

(56) References Cited

U.S. PATENT DOCUMENTS

| | | | | | |
|---|---|---|---|---|---|
| 2,492,801 | A | * | 12/1949 | Larson | 175/220 |
| 3,129,938 | A | * | 4/1964 | Riley | 269/157 |
| 4,081,986 | A | | 4/1978 | Break | 72/320 |
| 4,092,841 | A | | 6/1978 | Chambers, Jr. | 72/320 |
| 4,173,137 | A | * | 11/1979 | Metje | 72/320 |
| 4,489,583 | A | * | 12/1984 | Rhoades | 72/319 |
| 4,671,094 | A | | 6/1987 | Break | 72/319 |
| 6,532,789 | B1 | | 3/2003 | Chubb et al. | 72/319 |

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A sheet metal bending brake having a frame with a planar work supporting surface and a plurality of spaced frame members extending over the work support surface. Each frame member has a throughbore and these throughbores are aligned with each other. A plurality of elongated pivot arms are pivotally secured at one end to the frame for movement toward and away from the work supporting surface. Each pivot arm also includes a generally rectangular opening aligned with the frame member throughbores. A block is longitudinally slidably mounted in each pivot arm opening and this slide block is constrained against movement in a direction perpendicular to the work support surface. Each block furthermore includes a trapezoidal opening with spaced apart and parallel top and bottom surfaces and outwardly flared side surfaces. An elongated shaft extends through and is rotatably mounted to the frame member throughbores and this shaft also extends through the trapezoidal openings in the pivot arms. A plurality of eccentric cams are secured to the shaft so that one cam is associated with and positioned within each trapezoidal opening. This cam is dimensioned so that the cam contacts the outwardly flared side surfaces of its associated slide block regardless of the rotational position. Pivotal movement of the shaft thus displaces the pivot arms in a direction generally perpendicular to the work support surface due to the coaction of the eccentric cams with the side surfaces of the slide blocks.

6 Claims, 4 Drawing Sheets

SHEET METAL BENDING BRAKE

RELATED APPLICATION

This application claims priority of U.S. Provisional Patent Application Ser. No. 60/414,907 filed Sep. 30, 2002, which is incorporated herein by reference.

BACKGROUND OF THE INVENTION

I. Field of the Invention

The present invention relates to sheet metal bending brakes.

II. Description of Related Art

There are many previously known portable sheet metal bending brakes that are used in the building construction industry, typically for the installation of aluminum siding. These previously known sheet metal bending brakes typically comprise a frame having a planar work support surface and a plurality of spaced frame members which extend over the work support surface. Each frame member, furthermore, includes a throughbore so that the throughbores in the frame members are aligned with each other.

A plurality of elongated pivot arms are pivotally secured at one end to the frame for movement at their opposite ends toward and away from the work support surface. An elongated clamping bar is typically secured to the other ends of the pivot arms so that the clamp bar extends generally parallel to and spaced apart from the work support surface.

There have been a number of previously known mechanisms for pivotally moving the pivot arms in unison with each other and, accordingly, moving the clamp bar toward and away from the work support surface. Consequently, with the sheet metal positioned on the work support surface, the pivotal movement of the pivot arms toward the work support surface clamps the sheet metal between the clamp bar and the work support surface.

In one previously known sheet metal bending brake described in U.S. Pat. No. 4,671,094 to Break, issued Jun. 9, 1987, a circular opening was formed in each pivot arm so that the circular opening was aligned with, but eccentric to, the throughbores formed through the frame members. An elongated shaft was then rotatably mounted within each frame member throughbore and this shaft extended through the circular openings in the pivot arms.

In order to displace the pivot arms with their attached clamp bar upon rotation of the shaft, a plurality of circular cams were secured to the shaft so that one cam was positioned within the circular opening of each pivot arm. Consequently, pivotal movement of the shaft pivoted each cam due to the coaction of each cam with its opening in the pivot arms which vertically displaced the pivot arms with their attached clamp bar in the desired fashion.

A primary advantage of this previously known "cam lock" bending brake is that the pivot arms are able to lock on different thickness metal only within a relatively small range of thickness variation. Such locking was achieved when the major lobe of each cam was aligned within about 23 degrees or less of vertical when the pivot arms were in a locked position.

Conversely, for sheet metal as well as other materials having a thickness greater than the range accommodated by the bending brake, the cams are rotated outside the range of about 23 degrees with respect to vertical. When this happens, the frictional engagement of the cams with their circular openings in the pivot arms is insufficient to frictionally lock the cams against rotation to the pivot arms. When this occurred, the pivot arms would oftentimes "pop open" in use.

SUMMARY OF THE PRESENT INVENTION

The present invention provides a cam lock bending brake which overcomes all of the above-mentioned disadvantages of the previously known cam lock bending brakes.

In brief, the sheet metal bending brake of the present invention comprises a frame having a planar work support surface and a plurality of spaced frame members extending over the work support surface. Each frame member, furthermore, includes a throughbore so that the throughbores in the frame members are aligned with each other.

A plurality of elongated pivot arms are pivotally secured at one end to the frame so that the opposite ends of the pivot arms move toward and away from the work supporting surface as the pivot arms pivot relative to the frame. A clamp bar is attached to the pivot arms and overlies the work support surface. Each pivot arm also includes a generally rectangular opening which is aligned with the frame member throughbores.

A slide block is longitudinally slidably mounted in each pivot arm opening. This slide block, however, is constrained against movement in a direction generally perpendicular to the work support surface. Each slide block further includes a trapezoidal opening with spaced apart and parallel top and bottom surfaces and outwardly flared side surfaces.

An elongated shaft extends through both the frame member throughbores as well as the trapezoidal openings in the slide blocks. This shaft is rotatably mounted to the frame member throughbores by conventional bushings and thus is fixed against movement to the frame members other than rotational movement.

A plurality of eccentric cams are secured to the shaft so that one cam is associated with and positioned within each trapezoidal opening of each slide block. This cam, furthermore, has an outer circular surface dimensioned to contact the outwardly flared side surfaces of its associated slide block.

In operation, with work positioned between the clamp bar and work support surface, rotation of the shaft, preferably by a handle, rotates the cams and vertically displaces the pivot arms with their attached clamp bar toward and away from the work support surface in the desired fashion. Additionally, the slide block longitudinally displaces during the clamping action which maintains clamping frictional contact between the cam and both sides of the slide block trapezoidal opening regardless of the degree of opening between the clamp bar and the work support surface.

In a second embodiment of the invention, a cam having an outer circular surface is rotatably mounted in trapezoidal openings formed in the frame members. The trapezoidal openings include spaced apart and parallel upper and lower surfaces and side surfaces which taper inwardly in a direction away from the work support surface.

A link is rotatably mounted at one end to each cam along a first axis eccentric to the axis of rotation of the cam while the opposite end of each link is pivotally connected to each pivot arm. A shaft is then drivingly attached to each cam about the first axis so that rotation of the shaft by a handle vertically displaces the links and thus vertically displaces the pivot arms. The trapezoidal opening in the frame members, however, ensures that the cam maintains clamping frictional contact with both sides of the trapezoidal opening regardless of the degree of opening of the bending brake thereby achieving secure clamping for work pieces of a wide range of thicknesses.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
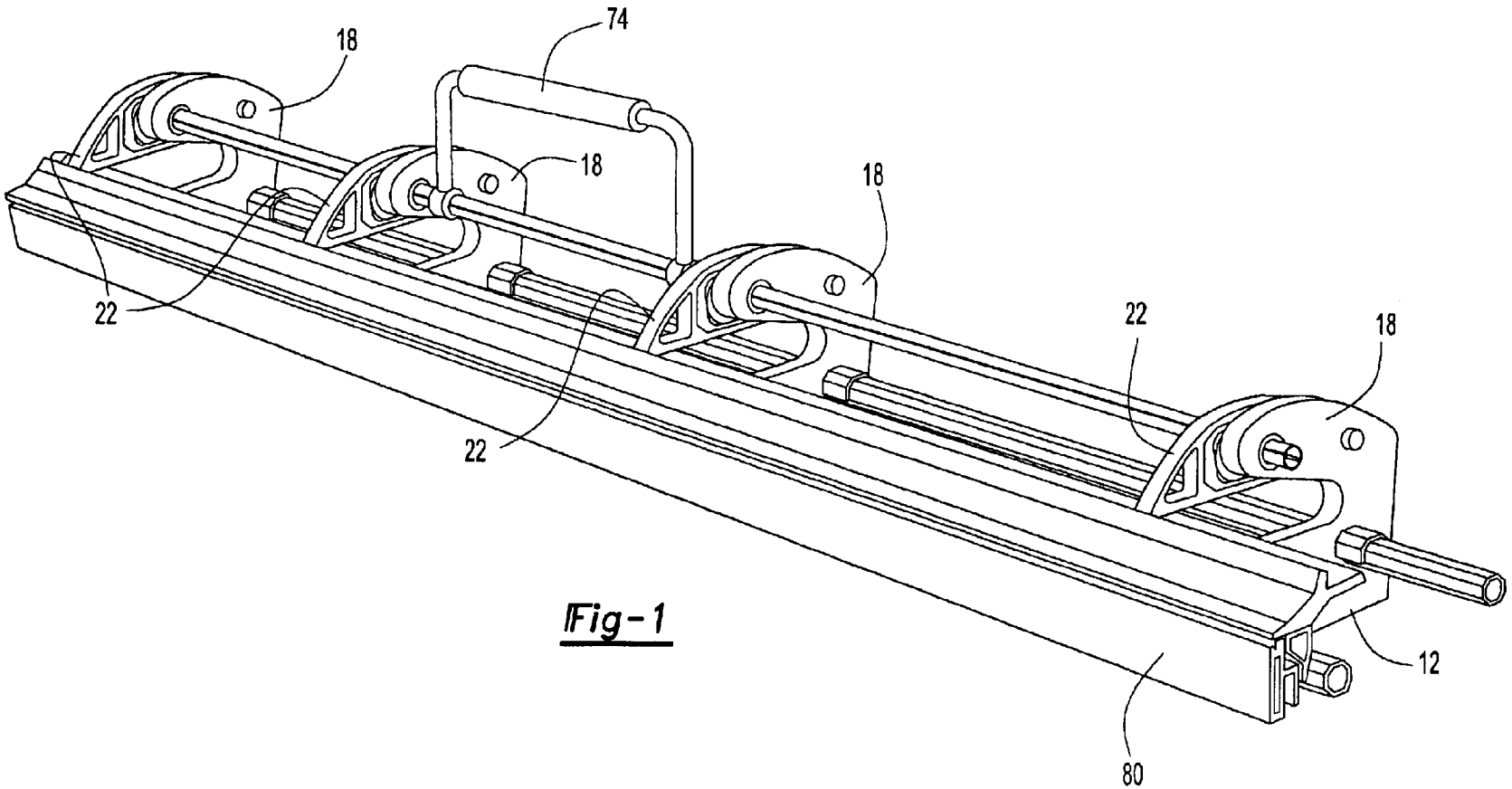
FIG. 1 is an elevational view illustrating a first preferred embodiment of the present invention.
Figure 2:
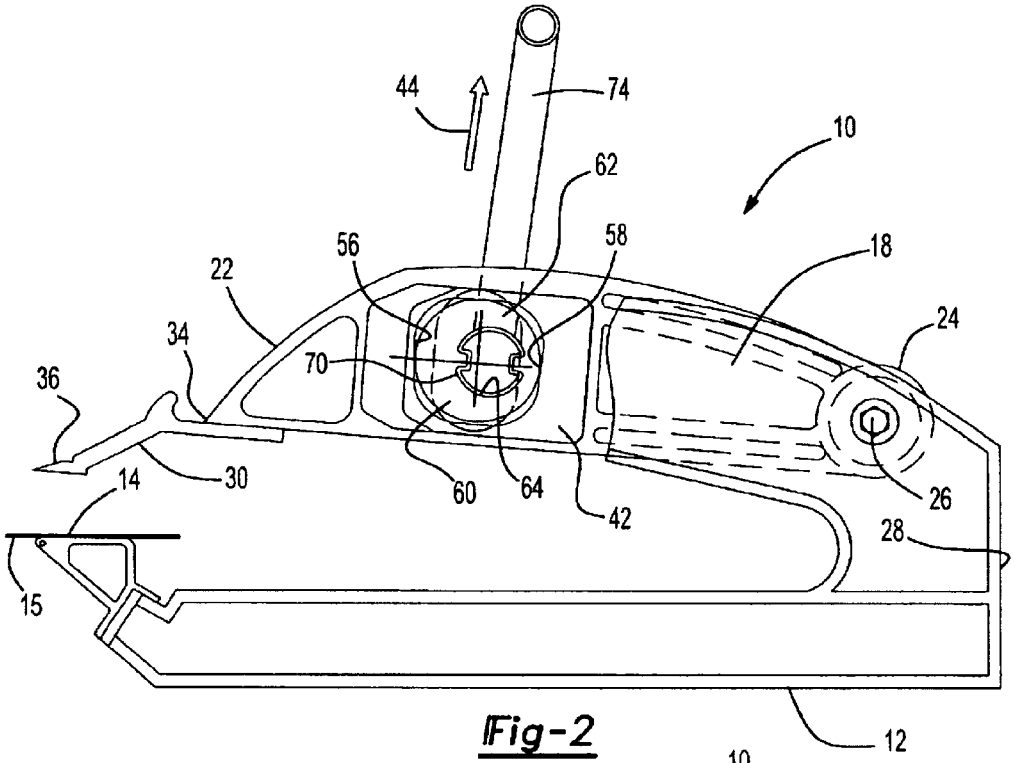
FIG. 2 is an end view of the first preferred embodiment of the invention in an unclamped position.

With reference first to FIGS. 1 and 2, a first preferred embodiment of the sheet metal bending brake 10 is shown having a frame 12 constructed of any rigid material, such as aluminum. The frame 12 defines an elongated and generally planar work support surface 14 (FIG. 2) extending along a front 16 of the bending brake 10 adapted to support a workpiece 15, such as a piece of sheet metal.

Figure 4:
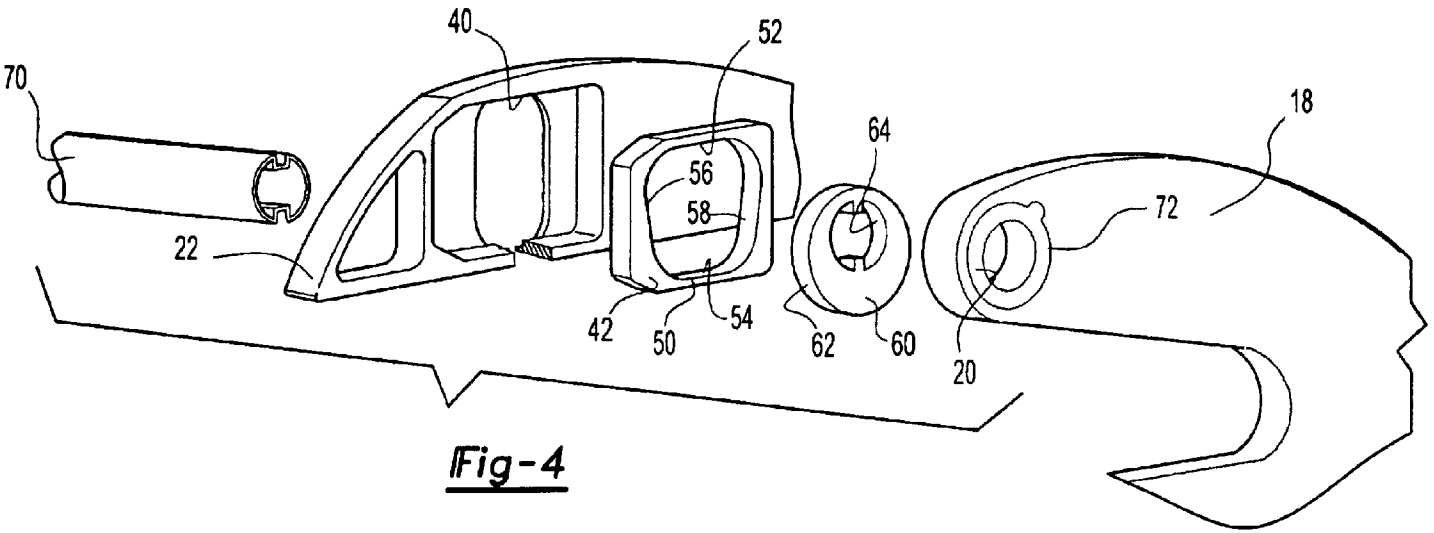
FIG. 4 is a fragmentary exploded view of a portion of the first preferred embodiment of the invention.

As best shown in FIGS. 1 and 4, the frame 12 further includes a plurality of laterally spaced apart frame members 18 which extend above the work support surface 14. Each frame member 18, furthermore, includes a throughbore 20 such that the throughbores 20 of the frame members 18 are aligned and coaxial with each other.

Figure 3:
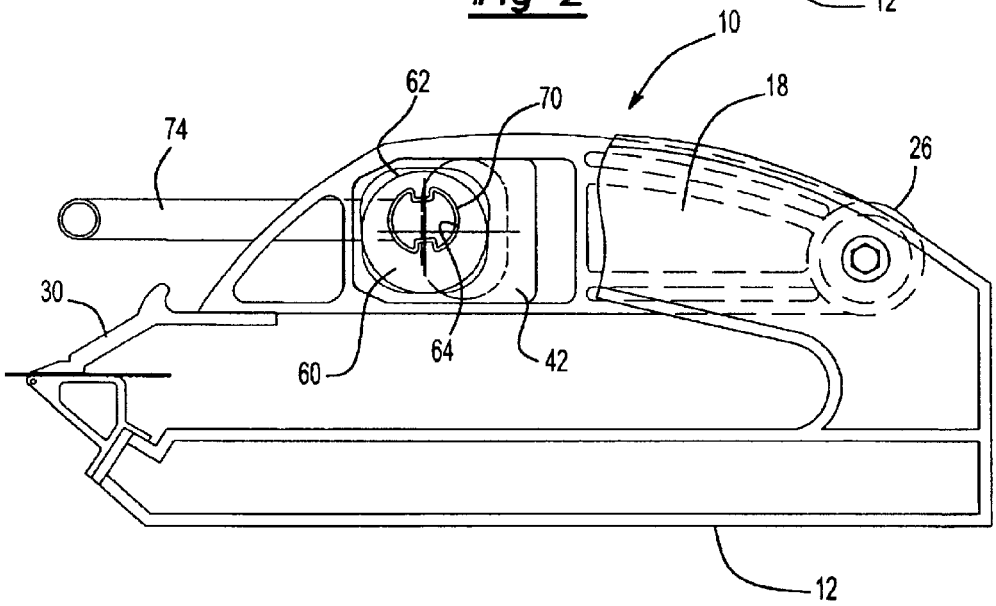
FIG. 3 is an end view of the first preferred embodiment of the invention in a clamped position.

With reference now particularly to FIGS. 2–4, a plurality of elongated pivot arms 22 each have one end 24 pivotally secured by a pin 26 (FIG. 2) to the frame 12 adjacent its rear side 28. An elongated clamp bar 30 is then secured by any conventional means to a front end 34 of each pivot arm 22 so that a portion 36 of the clamp bar 30 overlies and is aligned with the work support surface 14 of the frame 12. Consequently, pivotal action of the pivot arms 22 about their pivot pins 26 from the position shown in FIG. 2 to the position shown in FIG. 3 causes the portion 36 of the clamp bar 30 to move in a direction generally perpendicular to the work support surface 14 and between an unclamped and a clamped position.

Figure 5:
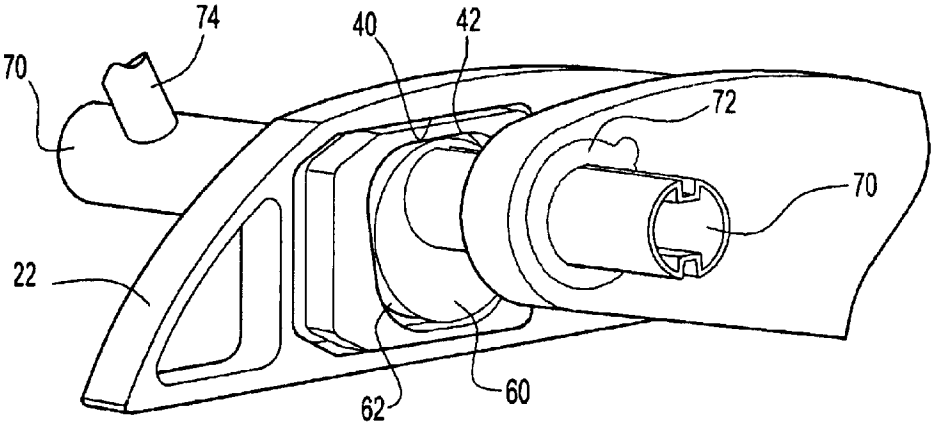
FIG. 5 is a fragmentary view of a portion of the first preferred embodiment of the invention.

With reference now to FIGS. 4 and 5, a generally rectangular opening 40 is formed through each pivot arm 22 and the rectangular openings 40 register with the throughbores 20 in the frame member 18. A slide block 42 is longitudinally slidably mounted within each rectangular opening 40 of the pivot arms 22 as shown in FIG. 5. Each slide block is longitudinally slidable in the opening 40 of its associated pivot arm 22 between the position shown in FIG. 2 and the position shown in FIG. 3. The slide blocks 42, however, are constrained against movement in the direction of arrow 44, i.e. in the direction generally perpendicular to the work support surface 14.

As best shown in FIG. 4, each slide block 42 includes a trapezoidal opening 50 having spaced apart and parallel top and bottom surfaces 52 and 54, respectively, as well as side surfaces 56 and 58. The side surfaces 56 and 58 flare outwardly from each other from the bottom surface 54 and toward the top surface 52.

With reference now particularly to FIGS. 2–5, a cam 60 having a circular outer surface 62 and an eccentric throughbore 64 is rotatably or pivotally positioned within each trapezoidal opening 50 of each slide block 42. The openings 64 in the cams 60 are aligned with and coaxial with the frame member apertures 20. Thereafter, an elongated shaft 70 extends through the frame member throughbores 20 as well as the cam bores 64 as best shown in FIG. 5. This shaft 70 is fixedly secured to the cams 60 against rotation and is also rotatably mounted to the frame member throughbores 20 by conventional bushings 72. A handle 74 secured to the shaft 70 facilitates pivotal movement of the shaft 70.

The cams 60 are dimensioned so that the cam 60 maintains contact with both the side surfaces 56 and 58 of the trapezoidal opening 50 in the slide block 42. Consequently, pivotal movement of the shaft 70 via the handle 74 or other means causes the cams 60 to rotate within their associated slide blocks 42. Due to the eccentricity of the cam 60, the coaction between the cam 60 and the slide blocks 42 causes the pivot arms 22 with their attached clamp bar 30 to move toward and away from the work support surface 14 as best shown in FIGS. 2 and 3.

Since the pivotal displacement of the pivot arms 22 varies as a direct function of the pivotal position of the cams 60, the actual position of the major lobe 76 of the cam 60 will vary depending upon the thickness of the clamped workpiece. However, since the slide blocks 42 longitudinally slide within their rectangular openings 40 in their associated pivot arms 22 as a function of the pivotal position of the cams 60, the cams 60 maintain contact with both side surfaces 56 and 58 of their associated trapezoidal opening 50 regardless of the rotational position of the cam 60. In doing so, the cam 60 frictionally wedges against both sides 56 and 58 of the slide block 42 regardless of the pivotal position of the cam 60 to provide a positive frictional lock regardless of the pivotal position of the cam 60.

Any conventional bending hinge 80 (FIG. 1) is pivotally mounted to the frame 12 adjacent the work support surface 14.

Figure 6:
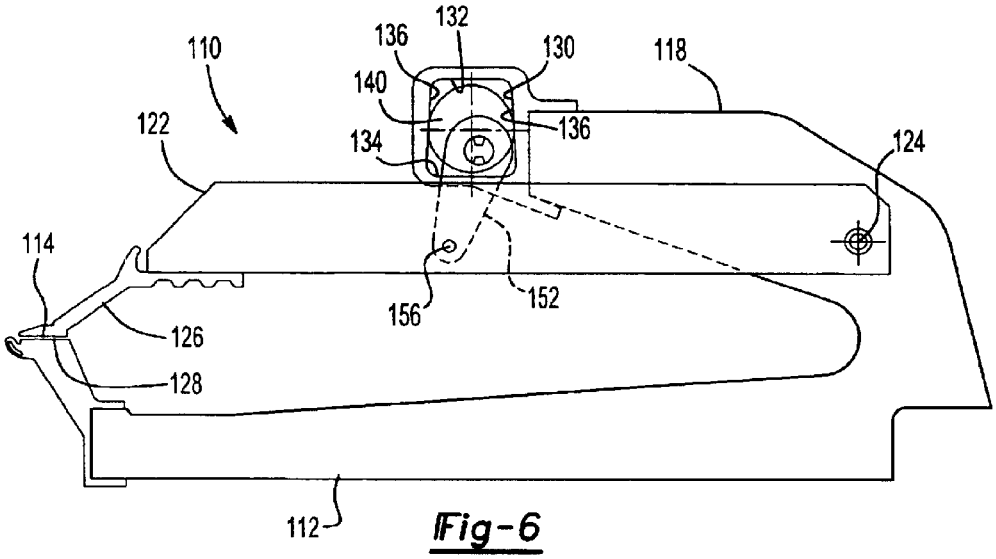
FIG. 6 is an end view similar to FIG. 3, but illustrating a second preferred embodiment of the invention.
Figure 7:
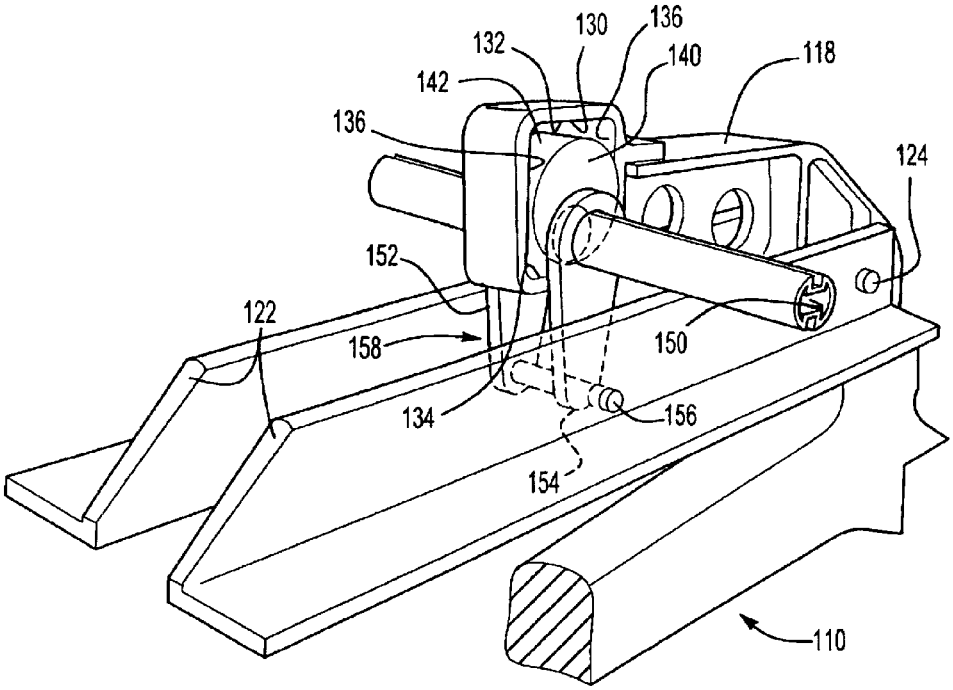
FIG. 7 is a fragmentary elevational view of a portion of the second preferred embodiment of the invention.

With reference now to FIGS. 6 and 7, a second preferred embodiment of the sheet metal bending brake 110 of the present invention is shown. Like the first embodiment of the invention, the bending brake 110 includes a frame 112 having a work support surface 114. The frame 112 also includes at least two spaced apart frame members 118 which are positioned above the work support surface 114.

A pivot arm 122 has one end pivotally secured by a pivot pin 124 to the frame 112. Additionally, an elongated clamp bar 126 is secured to the other end of the pivot arm 122 and the clamp bar 126 includes a planar surface 128 which is aligned with and overlies the work support surface 114 on the frame. Consequently, as before, pivotal movement of the pivot arm 122 about its pivot pin 124 causes the pivot arm 122 together with its attached clamp bar 126 to move toward and away from the work support surface 114.

Unlike the first embodiment of the invention, however, a trapezoidal opening 130 is formed in each frame member 118 so that the trapezoidal openings 130 are aligned with each other. The trapezoidal opening 130, furthermore, includes spaced apart top and bottom surfaces 132 and 134, respectively, as well as side surfaces 136. The side surfaces 136 taper inwardly towards each other from the bottom surface 134 of the opening 130 and toward the upper surface 132 of the opening 130.

A cam 140 having a circular outer surface is rotatably mounted within the trapezoidal opening 130. This cam 140 is dimensioned so that its outer cylindrical surface 142 abuts against both sidewalls 136 of the trapezoidal opening 130.

Still referring to FIGS. 6 and 7, an elongated shaft 150 extends through and is secured to each cam 130 so that the shaft 150 and cams 130 rotate in unison with each other. However, the axis of the shaft 150 is parallel to but radially offset from the axis of the cam 130 such that rotation of the cam 130 causes an oscillatory movement of the shaft 150.

An elongated link 152 has one end pivotally secured to the shaft 150. An opposite end 154 of the link 152 is pivotally secured by a pivot pin 156 to the link arm 122. Consequently, pivotal or rotational movement of the cam 130 by the shaft 150 causes the pivot arm 122 together with its attached clamp bar 126 to move toward and away from the work support surface 114 due to the eccentric connection between the link 154 and the cam 140.

Although the link 152 may be of any conventional construction, as best shown in FIG. 7, the pivot arm 122 preferably includes a lower yoke 158 such that the yoke 158 overlies both sides of the pivot arm 122. As such, any torsional force between the link 152 and the pivot arm 122 is minimized.

During a clamping operation, the link 152 transmits the clamping force to the cam 140 which ensures that the cam 140 maintains a clamping frictional contact with both sides 136 of the opening 130 regardless of the thickness of the workpiece being clamped.

From the foregoing, it can be seen that the present invention provides a sheet metal bending brake which is capable of positively locking workpieces of a wide range of thicknesses. A still further advantage of the present invention is that even a workpiece having an inclined upper surface may be positively clamped since the cams 60 may be variably pivoted relative to each other, within at least a limited range.

Furthermore, although the present invention has been described as a sheet metal bending brake, it will be appreciated that the clamping mechanism may be used in other fields and for other applications other than sheet metal bending brakes.

Having described my invention, many modifications thereto will become apparent to those skilled in the art to which it pertains without deviation from the spirit of the invention as defined by the scope of the appended claims.

I claim:

1. A sheet metal bending brake comprising:

a frame having a planar work support surface and at least two spaced frame members extending above said work support surface, each frame member having a throughbore such that said throughbores in said frame members are aligned with each other, at least two elongated pivot arms, each arm being pivotally secured at one end to said frame for movement toward and away from said work support surface, each pivot arm having a generally rectangular opening aligned with said frame member throughbores, a clamp bar secured to said pivot arms so that said clamp bar overlies said work support surface, a slide block longitudinally slidably mounted in each pivot arm opening, said slide block being constrained against movement in a direction generally perpendicular to said work support surface, wherein each slide block includes a trapezoidal opening with spaced apart and parallel top and bottom surfaces and outwardly flared side surfaces, an elongated shaft rotatably mounted in said frame member throughbores, said shaft extending through said trapezoidal openings, at least two eccentric cams secured to said shaft so that one cam is associated with and positioned within each trapezoidal opening, said cam being dimensioned so that each said cam contacts said outwardly flared side surfaces of its associated slide block, whereby pivotal movement of said shaft displaces said clamp bar in a direction generally perpendicular to said work support surface.

2. The invention as defined in claim 1 wherein each said cam contacts said top and bottom surfaces of its associated slide block.

3. The invention as defined in claim 1 and comprising a bending hinge pivotally mounted to said frame.

4. The invention as defined in claim 1 and wherein said clamp bar is elongated and secured to a second end of each said pivot arm so that said clamp bar is parallel to an spaced away from said work support surface.

5. The invention as defined in claim 1 and comprising a radially outwardly extending handle secured to said shaft.

6. A clamp assembly comprising:

a frame having a planar work support surface and at least two spaced frame members extending above said work support surface, each frame member having a throughbore such that said throughbores in said frame members are aligned with each other, at least two elongated pivot arms, each arm being pivotally secured at one end to said frame for movement toward and away from said work support surface, each pivot arm having a generally rectangular opening aligned with said frame member throughbores, a clamp bar secured to said pivot arms so that said clamp bar overlies the work support surface, a slide block longitudinally slidably mounted in each pivot arm opening, said slide block being constrained against movement in a direction generally perpendicular to said work support surface, wherein each slide block includes a trapezoidal opening with spaced apart and parallel top and bottom surfaces and outwardly flared side surfaces, an elongated shaft rotatably mounted in said frame member throughbores, said shaft extending through said trapezoidal openings, at least two eccentric cams secured to said shaft so that one cam is associated with and positioned within each trapezoidal opening, said cam being dimensioned so that each said cam contacts said outwardly flared side surfaces of its associated slide block, whereby pivotal movement of said shaft displaces said clamp bar in a direction generally perpendicular to said work surface.

* * * * *